United States Patent [19]

Landa

[11] 4,253,656

[45] Mar. 3, 1981

[54] APPARATUS FOR COLLATING OR OTHERWISE SORTING THE OUTPUT OF SHEET-DELIVERING DEVICES

[75] Inventor: Benzion Landa, Edmonton, Canada

[73] Assignee: Savin Corporation, Valhalla, N.Y.

[21] Appl. No.: 57,319

[22] Filed: Jul. 13, 1979

[51] Int. Cl.[3] ..... B65H 31/24; B65H 39/11

[52] U.S. Cl. ..... 271/293; 271/294

[58] Field of Search ..... 271/294, 293, 292, 287, 271/288, 289, 290, 291, 295; 270/58; 414/51

[56] References Cited

U.S. PATENT DOCUMENTS

| | | | |
|---|---|---|---|
| 3,802,694 | 4/1974 | Post et al. | 271/294 X |
| 4,162,787 | 7/1979 | Shirahase et al. | 271/293 |
| 4,203,587 | 5/1980 | Kishi et al. | 271/293 |

FOREIGN PATENT DOCUMENTS

| | | | |
|---|---|---|---|
| 2733521 | 2/1978 | Fed. Rep. of Germany | 271/294 |

OTHER PUBLICATIONS

Clarkson, S. et al., "Sheet Sorter", *Xerox Disclosure Journal*, vol. 1, No. 4, Apr. 1976, p. 59.

*Primary Examiner*—Bruce H. Stoner, Jr.
*Attorney, Agent, or Firm*—Shenier & O'Connor

[57] ABSTRACT

Apparatus for collating, stacking or otherwise sorting successive sheets of paper delivered from the output station of a sheet-delivering device, for example, from a photocopier. A compact stack of a selected number of sheet-receiving trays is lifted above the output station and the trays are caused to drop one at a time to a position below the output station such that each can receive one or more sheets from the output station. In a preferred embodiment, the trays are mounted to move between the top and bottom of a vertically movable frame in which the trays are lifted to form an upper stack from which they are successively dropped to form a lower compact stack with an intervening space into which the sheets are delivered to be deposited on the uppermost tray of the lower stack. The top of the frame is supported by the upper stack and the bottom of the frame supports the lower stack whereby, as the height of the upper stack is progressively reduced, the height of the lower stack is increased, but since the frame lowers with the upper stack, the position and dimensions of the sheet-receiving space between stacks remains substantially constant. Mechanical and electrical devices and controls are provided for automatic or manual operation in various modes and in proper timed relation with delivery of sheets from the output station.

12 Claims, 11 Drawing Figures

1
2
3
4
10
18
22
24
26
28
30
31
32
33
34
36
38
40
42
44
46
48
50
52
54
56
57
58
60
62
64
66
72
73
78
81
86
88
100
101
102
104
107
114
116
120
130
136
138
140
142
150
151
154
156
158
160
168
168A
168B
169
170
172
174
180

APPARATUS FOR COLLATING OR OTHERWISE SORTING THE OUTPUT OF SHEET-DELIVERING DEVICES

BACKGROUND OF THE INVENTION

It is often desirable to collate or otherwise sort the output of machines such as printers, duplicators or photocopiers equipped with sheet-delivering mechanisms. Collating involves placing one copy of each page of a multipage original in separate stacks, each in the same order as that of the original. Automatic collating devices usually are provided with a series of bins, in each of which a complete ordered copy of the original document is deposited. Other forms of sorting may also be desirable. For example, at times, it may be advantageous to automatically stack copies of different original pages, or different numbers of copies of the same original page, in separate bins.

The prior art discloses devices of various types for automatically collating and sorting. Many of them are large and expensive, involving many individual stationary bins in a frame and complicated paper-moving apparatus for altering the path of movement of sheets for directing them as desired to individual bins. Others involve the use of movable trays brought successively to the output station of a sheet-delivering machine, usually with some provision for increasing the spacing between the trays at the output station to facilitate entry therebetween of a delivered sheet. This invention lies within the latter type.

1. Field of the Invention

This invention relates to a sheet-material sorting apparatus of a type wherein movable trays are brought to the output station of a sheet-delivering machine. The trays are individually movable relative to one another for this purpose, and the trays are then movable as a group to reposition them for receipt of the next group of sheets.

2. Description of the Prior Art

One example of a collator of the prior art in which several individual trays are fixed in a frame is that shown in U.S. Pat. No. 3,467,371 to Britt et al. Another general type of prior-art sorting apparatus provides a stack of bins in a frame which moves vertically past the output station of a sheet-feeding device so that successive sheets are placed in successive bins. To save space, some of the prior-art devices use frames or standards for supporting individually movable trays which might be compressed when not in sheet-receiving position and moved apart when in sheet-receiving position. The present invention is of that latter general type. In U.S. Pat. No. 3,788,640 to Stemmle, and U.S. Pat. No. 3,995,748 to Looney, camming devices are used to compress the individually movable bins or trays when they are not in sheet-receiving position. Such camming devices and related apparatus are very complicated, and they inflexibly fix the distance between bins when the bins are compressed. This inflexibility causes problems when a large number of sheets are inserted into any given bin. A similar problem of inflexibility exists with the apparatus disclosed in U.S. Pat. No. 3,721,435 to Zanders, which uses notched belts, rather than cams, to widen and compress the bins. A somewhat different sorting apparatus is disclosed in Xerox Disclosure Journal, page 59 of Volume 1, No. 4, April 1976. Such apparatus has a plurality of trays, each hinged at its rear lower edge. The front edges of all of the trays are tilted up above the sheet-output station and then are allowed to fall one-by-one to below the output station, so that a sheet might be received between the most recently dropped tray and the tray immediately above it. Unfortunately, since the trays of this apparatus are hinged closely together at one end, sheets tend to become pinched if a large number of them are placed between any two trays. Also, the width of the gap between trays at the output station varies greatly as successive trays fall from above to below the output station, decreasing the chance that the sheets will be uniformly placed between different trays.

SUMMARY OF THE INVENTION

In general, the present invention provides apparatus for collating or sorting successive sheets delivered from the output stations of printers, duplicators or photocopiers equipped with sheet-delivering devices. My apparatus comprises a plurality of generally vertically stacked sheet-receiving trays and means for lifting the stack of trays above the output station of a sheet-delivering device, together with means for dropping the trays one-by-one to the receiving position relative to the output station. The sheet or sheets delivered from the output station at any given time will be received on top of the tray most recently dropped while the earlier dropped trays with sheets thereon will be formed into a stack below the output station.

The apparatus provides a collating mode which when initiated lifts all the trays above the output station, then drops one tray for each successive copy of a given page of a multipage original document to land on. By repeating this process with the same trays for each page of a multi-page original, a collated multipage copy of the original will be placed on each of the dropped trays. Alternatively, the apparatus provides a stacking mode in which, for example, ten copies of a single original page may be delivered to one tray, four copies of that same page may be delivered to the next tray, and so on, to provide for distribution of differing numbers of identical copies to various destinations. Furthermore, the stacking mode may be utilized to deliver the same or differing numbers of copies of different originals to successively presented trays.

The apparatus includes illustrative forms of electronic control circuits and devices for automatic operation of the apparatus in any of the selected modes in response to signals supplied manually for mode selection and supplied from the sheet-delivering device with which the sorting apparatus is associated. The apparatus also illustratively provides for single-step operation wherein the trays may be dropped individually and successively by manual signal.

One object of my invention is to provide a simple, compact and inexpensive sheet sorter capable of collating, as well as other forms of sorting, and which receives sheets between parallel trays which are successively dropped to sheet-receiving position.

Another object of my invention is to provide a sheet sorter consisting generally of a main frame or housing which may be integrally built into or may be removably attached to a machine having a sheet-delivering apparatus—for example, a photocopying machine. Such a main frame carries within it an independently movable subframe or cage on which a plurality of trays are arranged for generally vertical motion to be successively presented to the output station and thereafter to sink below the level of the output station as succeeding trays are dropped from above to the sheet-delivery position.

Still another object of my invention is to provide a sheet sorter having a very short paper path and thus which presents a very small likelihood of jamming of sheets.

Other and further objects of my invention will appear from the following description.

BRIEF DESCRIPTION OF THE DRAWINGS

In the accompanying drawings, which form part of the instant specification and which are to be read in conjunction therewith, and in which like reference characters are used to indicate like parts in the various views.

DESCRIPTION OF THE PREFERRED EMBODIMENT

Figures 1, 1A, 1B:
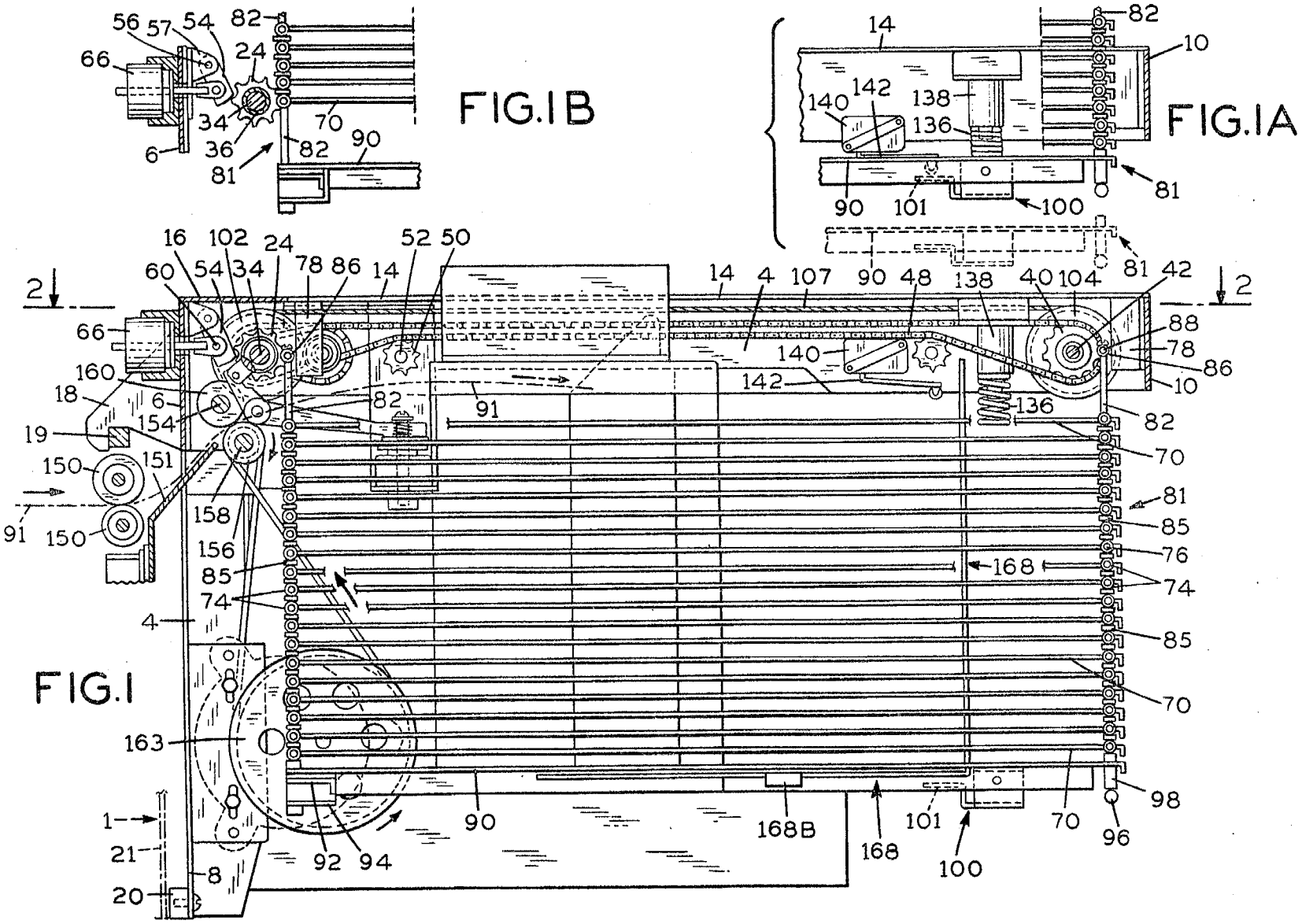
FIG. 1 is a front elevational view of a sorting apparatus constituting a preferred embodiment of the present invention, with certain parts in section taken generally in the plane of line 1—1 of FIG. 2 and with other parts broken away.
FIGS. 1A and 1B are fragmentary views, similar to FIG. 1, but with parts in different operative positions.

Referring now to the drawings, the sorting apparatus as shown in FIG. 1 is designed to be releasably attached to and to receive photocopies from the sheet-delivering mechanism of a photocopier 1, although it will be understood that the sorting apparatus may be integrally built into such a photocopier if so desired. Throughout this specification, I shall refer to the delivery end of my sorting apparatus which is used with photocopier 1 as the "left end" and the side which faces the normal position of a person operating the copier as the "front". The left and right ends of my sorter are shown, respectively, on the left and right sides of FIGS. 1, 2, and 5. The front and rear sides of my sorter are shown, respectively, at the bottom and top of FIG. 2. Also, throughout this specification, rotary motion is described as being either counterclockwise or clockwise as viewed from the front of the sorter, unless otherwise specifically stated.

Figure 2:
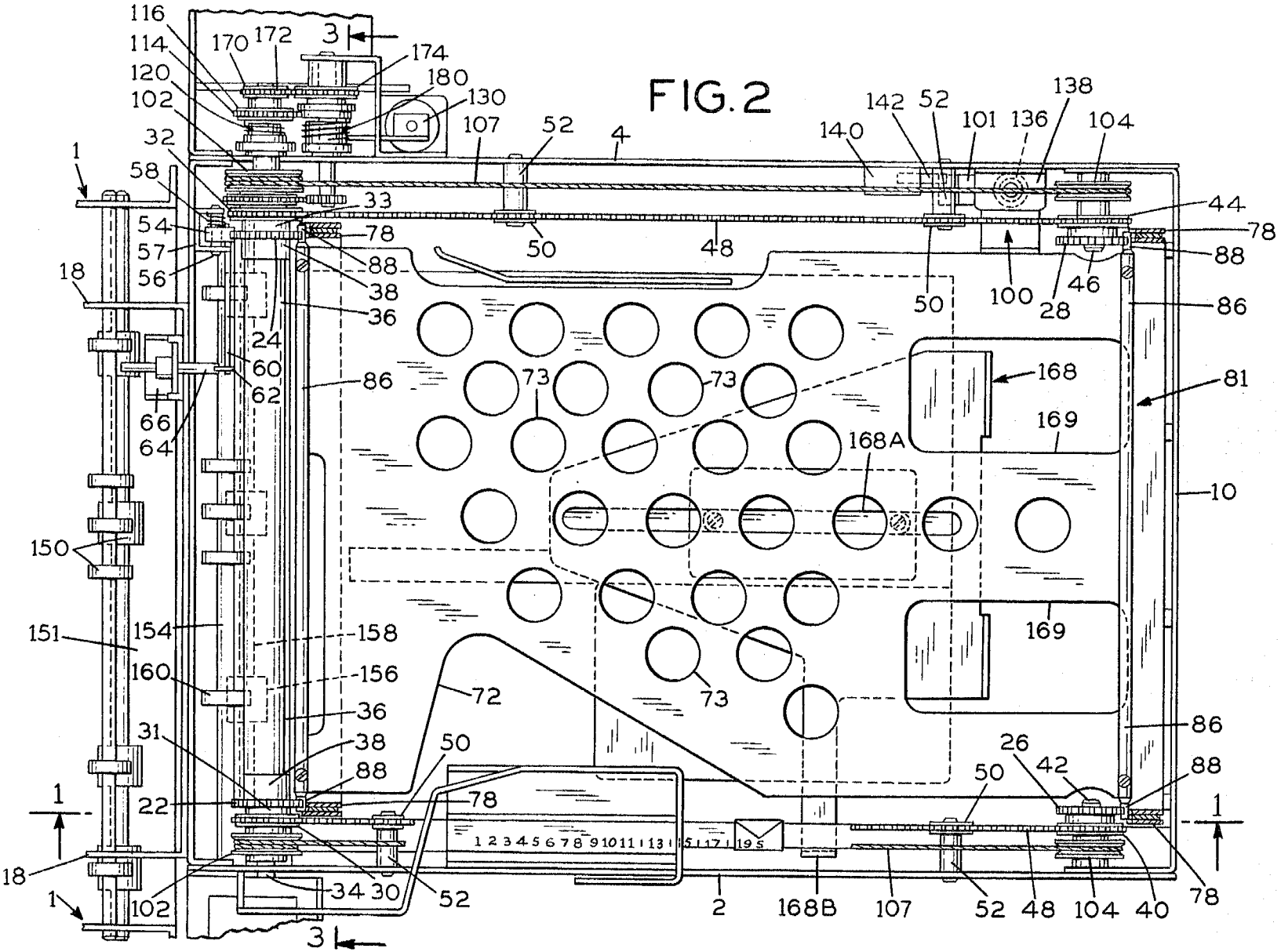
FIG. 2 is a top plan view of the sorting apparatus, with certain parts removed for clarity and with parts in section taken generally along lines 2—2 of FIG. 1.
Figure 3:
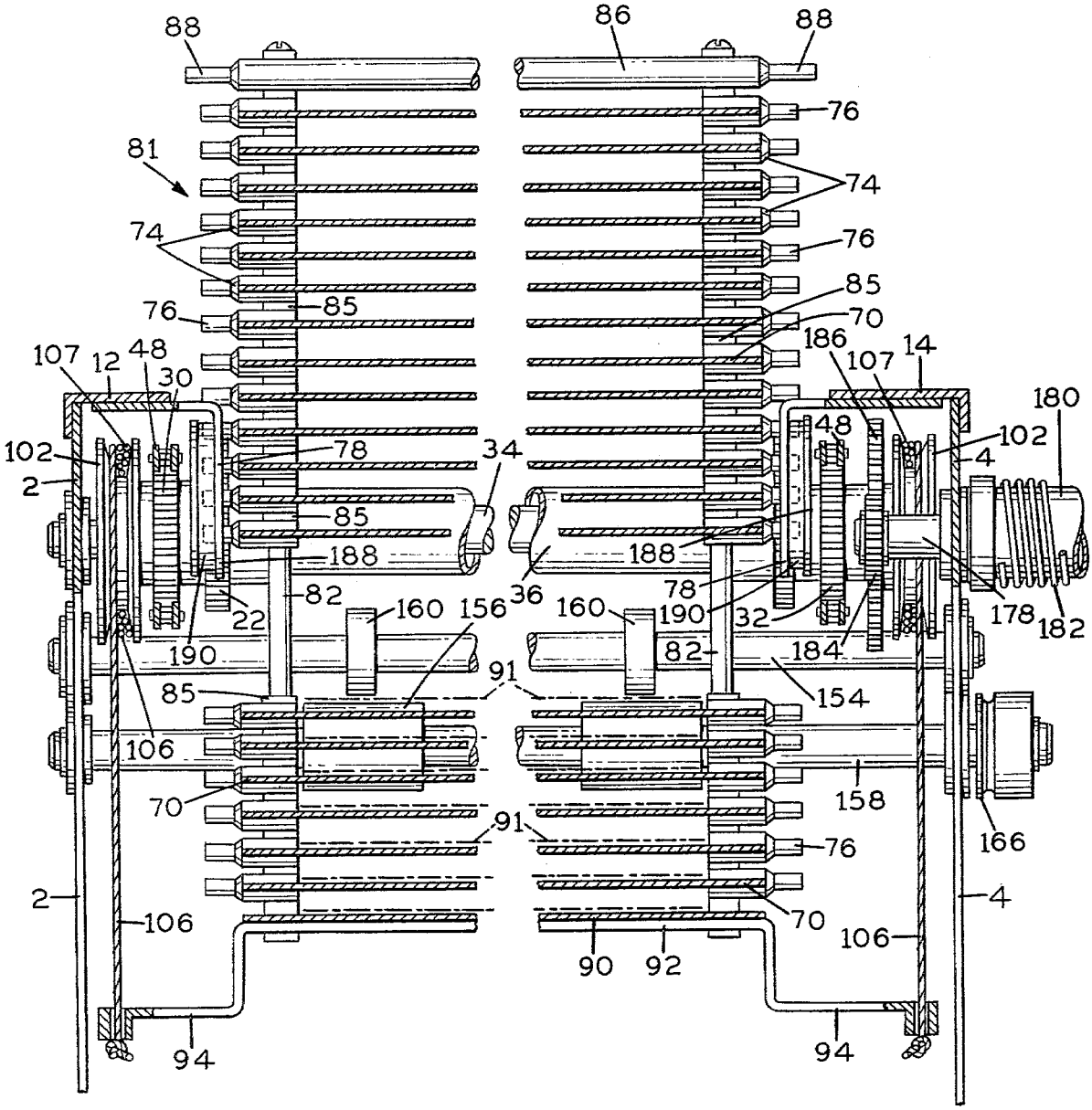
FIG. 3 is a fragmentary vertical sectional view taken along lines 3—3 in FIG. 2, but with certain parts in positions differing from those in FIG. 1.

My sorting apparatus includes, as shown in FIG. 2, a housing comprising a front plate 2 and a back plate 4 parallel with plate 2. Plates 2 and 4 are connected on the left side by an upper left transverse plate 6 and a lower left transverse plate 8 (FIG. 1) and on the right by a right transverse plate 10. As shown in FIG. 3, the housing also includes a front chain cover 12 attached to the top of plate 2; a back chain cover 14 attached to the top of plate 4; and as shown in FIG. 1, a main shaft cover 16 attached to the top of transverse plate 6. The housing just described is provided with any suitable means for convenient attachment to the copier 1 when it is desired to use my sorting apparatus. For example, a pair of brackets 18 may be attached to upper plate 6 arranged to hook onto a horizontal member 19 forming a part of the inner frame of copier 1. Two spacers 20 are attached to the lower plate 8 and rest against the right end wall 21 of copier 1 thus to cooperate with brackets 18 in holding the sorting apparatus firmly but releasably in the operating position shown in FIG. 1.

Figure 4:
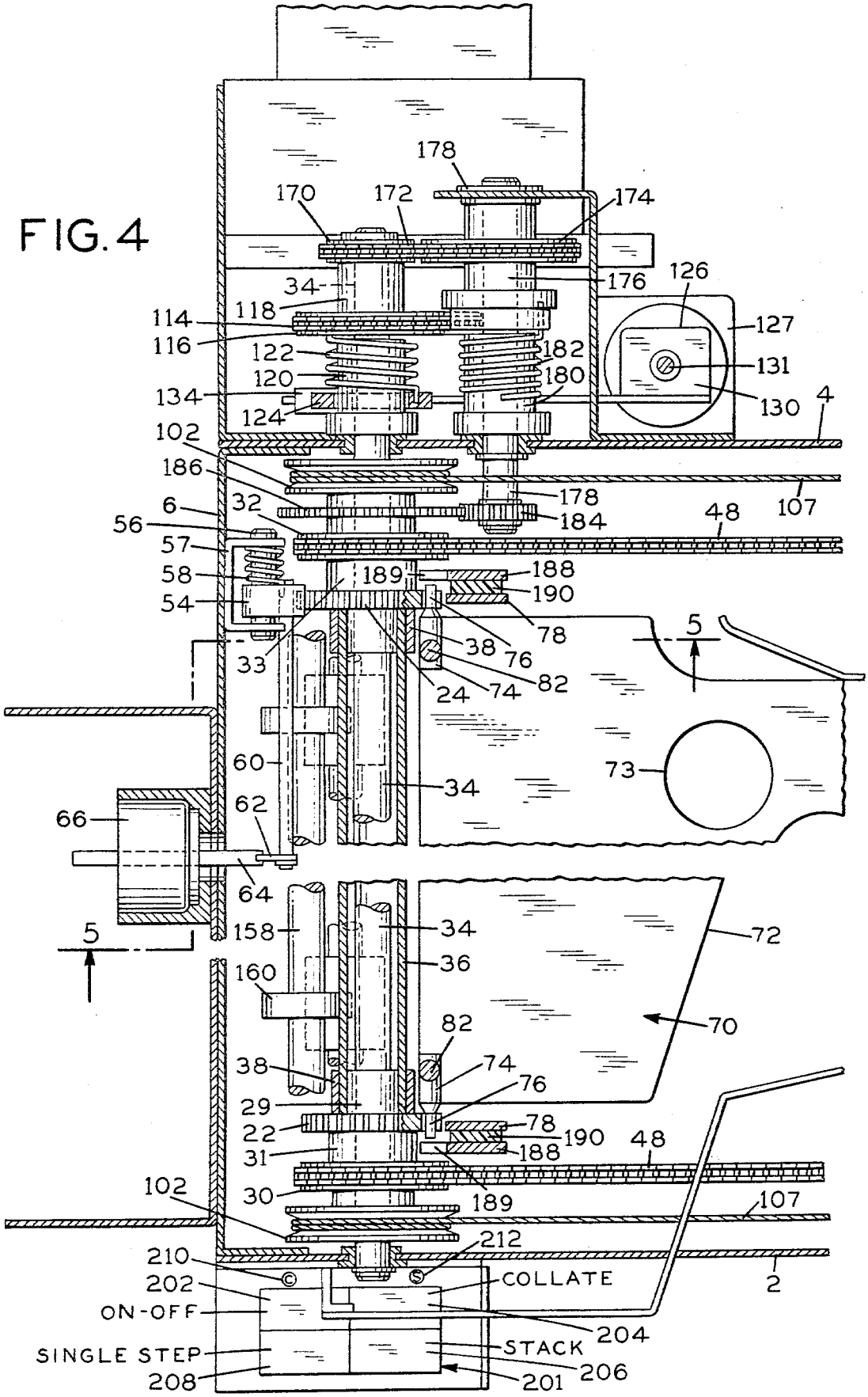
FIG. 4 is a fragmentary horizontal sectional view of the apparatus to FIG. 1, drawn on an enlarged scale, showing details of the mechanism for moving trays within the frame.

My sorting apparatus employs four toothed indexing wheels 22, 24, 26, and 28 for controlling the copy-receiving trays of the apparatus. As best shown in FIGS. 2 and 4, the wheel 22 is fixed on a step 29 of a hub 31 of a drive sprocket 30 for rotation therewith. Indexing wheel 24 is similarly mounted on a hub 33 of a drive sprocket 32. Sprockets 30 and 32 are journaled for rotation on a main shaft 34, which is itself rotatably carried by plates 2 and 4. The reduced-diameter step portions of the hubs of sprockets 30 and 32 are fixed to a spacer sleeve 36 concentric with shaft 34 by clamping rings 38 (FIG. 4). Thus, the sprockets 30 and 32, wheels 22 and 24, and the spacer sleeve 36 constitute a unit rotatable upon shaft 34.

At the right-hand end of the sorter as viewed in FIG. 2, the indexing wheel 26 is fixed for rotation with a driven sprocket 40 journaled on a stub shaft 42 mounted in plate 2. Indexing wheel 28 is similarly fixed for rotation with a driven sprocket 44 journaled on a stub shaft 46 mounted in plate 4. Two parallel drive chains 48 connect sprocket 30 with sprocket 40 and connect sprocket 32 with sprocket 44 respectively. The lower reaches of both drive chains 48 are supported between their respective drive and driven sprockets by pairs of longitudinally spaced chain-tensioning idler sprockets 50 journaled on stub shafts 52 mounted in plates 2 and 4 respectively. Sprockets 30, 32, 40, and 44 are all the same size whereby the four indexing wheels 22, 24, 26, and 28 will rotate at the same angular velocity under control of chains 48. The notches or serrations between adjacent teeth of each of the indexing wheels 22, 24, 26, and 28, as best shown in FIGS. 1 and 1B, are generally semi-circular so as to individually receive cylindrical pins, to be described below, mounted on the four corners of each of the copy-receiving trays.

As shown in FIGS. 1 and 4, a pawl 54 is mounted on a shaft 56 journaled in a bracket 57 mounted on plate 6 adjacent to indexing wheel 24. A torsion spring 58 (FIG. 4) concentric with stub shaft 56 is connected between bracket 57 and pawl 54 to bias the lower right corner (FIG. 1) of pawl 54 counterclockwise into the serrations between the teeth of wheel 24. Pawl 54, utilizing the teeth of wheel 24 as a ratchet, will yield to normally permit counterclockwise rotation, but will prevent clockwise rotation, of indexing wheel 24 as well as indexing wheels 22, 26, and 28 connected therewith. An elongated pin 60 fixed to pawl 54 receives the eye of a link 62 pivotally connected to the free end of a solenoid plunger 64 extending from a fixed solenoid 66 (FIG. 4). When solenoid 66 is energized, the plunger 64 will be retracted to withdraw pawl 54 from the teeth of wheel 24. When solenoid 66 is de-energized, spring 58 will swing pawl 54 counterclockwise into engagement with the teeth of wheel 24 and will return plunger 64 to the position shown in FIGS. 1 and 4. In this position of parts, pawl 54 prevents indexing wheel 24, and those wheels which rotate in unison with it, from rotating in a clockwise direction while permitting counterclockwise rotation as explained above. When solenoid 66 is again energized, all four indexing wheels will be freed for rotation in either direction.

The function of the four indexing wheels 22, 24, 26, and 28 is to support a plurality of vertically stacked sheet-receiving trays 70 and, acting in the manner of escapement wheels, to successively drop such trays to a sheet-receiving position. In the embodiment of my invention shown in the drawings, there are nineteen of these trays 70, all of them being identically shaped, generally rectangular, and made of flat sheet metal. As shown in FIG. 2, each tray 70 has a notch or indentation 72 formed therein to facilitate the removal of photocopies placed upon it and a plurality of circular openings 73 to lighten the structure and to reduce air-cushioning. A separate cylindrical corner pin, generally indicated by reference numeral 74, is mounted on each of the four corners of each tray 70. The corner pins 74 are axially aligned parallel with the left and right edges of each tray 70. As best shown in FIG. 4, each pin 74 is formed with a cylindrical extension 76 of reduced diameter coaxial with the body of the pin and extending beyond the front or back edge of the tray 70 to which it is attached. As shown in FIGS. 1, 2, and 4, pin guides 78 are supported by chain covers 12 and 14, one immediately to the right of each of the indexing wheels 26 and 28. The diameter of each of the pin extensions 76 is such as to fit freely in the semi-circular serrations or notches between the teeth of the indexing wheel to which it is guided by a pin guide 78. Thus, all four of the extensions 76 on a particular tray 70 will be simultaneously guided into a notch of one of the indexing wheels when the latter are permitted to rotate clockwise as viewed in FIG. 1 and will be held securely in that notch by the adjacent pin guide. Since pawl 54 normally prevents clockwise rotation of the indexing wheels, a tray 70 having all four extensions 76 engaged between an indexing wheel and an adjacent pin guide will be firmly supported in a generally horizontal plane and will be ready to escape and drop by gravity when counterclockwise movement of the indexing wheels is permitted.

The identically shaped trays 70 are stacked in registry and are mounted for individual vertical sliding motion within a tray frame or cage 81 which itself is vertically movable within the housing 12. Cage 81 comprises four vertical slide rods 82 (FIGS. 3 and 4), which extend through holes located in the corners of each tray 70 and aligned holes in the corner pins 74 respectively mounted on these corners. A spacing ring 85 is placed around or strung upon each rod 82 between each of the trays 70. The left and the right pairs of rods 82, as viewed in FIG. 1, are each connected at the top by a horizontal bar 86 having cylindrical extensions 88 of reduced diameter located at opposite ends thereof. These extensions, as best shown in FIG. 3, have the same diameter as, and are vertically aligned with, the tray corner pin extensions 76, but the extensions 88 are longer than the extensions 76. The lower end of each rod 82 is fixed to a bottom tray 90 which may be generally of the same shape as the movable trays 70. Attached to the lower left edge of the tray 90 (FIG. 3) is a cable anchor bar 92, having lower extensions 94 extending respectively beyond the front and rear edges of tray 90. Attached to the lower right edge of tray 90 (see FIG. 1) is a cable anchor bar 96, positioned by two spacers 98 the same distance below tray 90 as are the lower extensions 94 of bar 92. Also connected to the bottom of tray 90 is a limit stop 100 which extends beyond the rear edge of that tray (see FIG. 2). Because the trays 70 are slideably mounted on the vertical slide rods 82 of the frame 81, they may be arranged in one of two stacks—an upper stack, the lowermost tray 70 of which is supported by the pins 74 engaged in the four indexing wheels, or a lower stack, the lowermost tray of which rests upon the bottom tray 90 which, as explained above, constitutes a part of the cage or frame 81. In FIG. 3, it will be noted that there is a vertical space between the two stacks into which the sheets delivered by the associated sheet-delivering device are projected for deposit on the uppermost tray in the lower stack. It will be understood that this space is provided as a result of making the four vertical slide rods 82 larger than the total height of the stack of trays when all of the trays are arranged in one stack. In FIG. 1, all of the trays 70 are in the lower stack and the cage 81 is supported by the pin extensions 88 engaged in the indexing wheels.

My invention includes apparatus for lifting all of the trays 70 into the upper stack. Such position is illustrated in FIGS. 1A and 1B. As best shown in FIGS. 2 and 3, the lifting apparatus includes two cable drums 102 fixedly mounted upon the shaft 34 slightly inboard of plates 2 and 4, respectively, for rotation therewith. A cable pulley 104 (see FIG. 2) is journaled for free rotation on the stub shaft 42, which also carries indexing wheel 26, slightly inboard of plate 2, and a similar cable pulley 104 is journaled on the stub shaft 46, slightly inboard of plate 4 of the main housing. Two flexible suspension cables 106 and 107 are fixed at one end in each drum 102. The free ends of cables 106 extend downwardly from each drum 102 and are secured respectively to the opposite lower extensions 94 of bar 92 (see FIG. 3). The other cables 107 (see FIGS. 1 and 2) extend from each drum 102 toward the right-hand end of the apparatus, over the pulleys 104, whence the free ends thereof extend downwardly to be secured respectively to the opposite ends of cable anchor bar 96 located beneath the right-hand edge of bottom tray 90.

Figure 5:
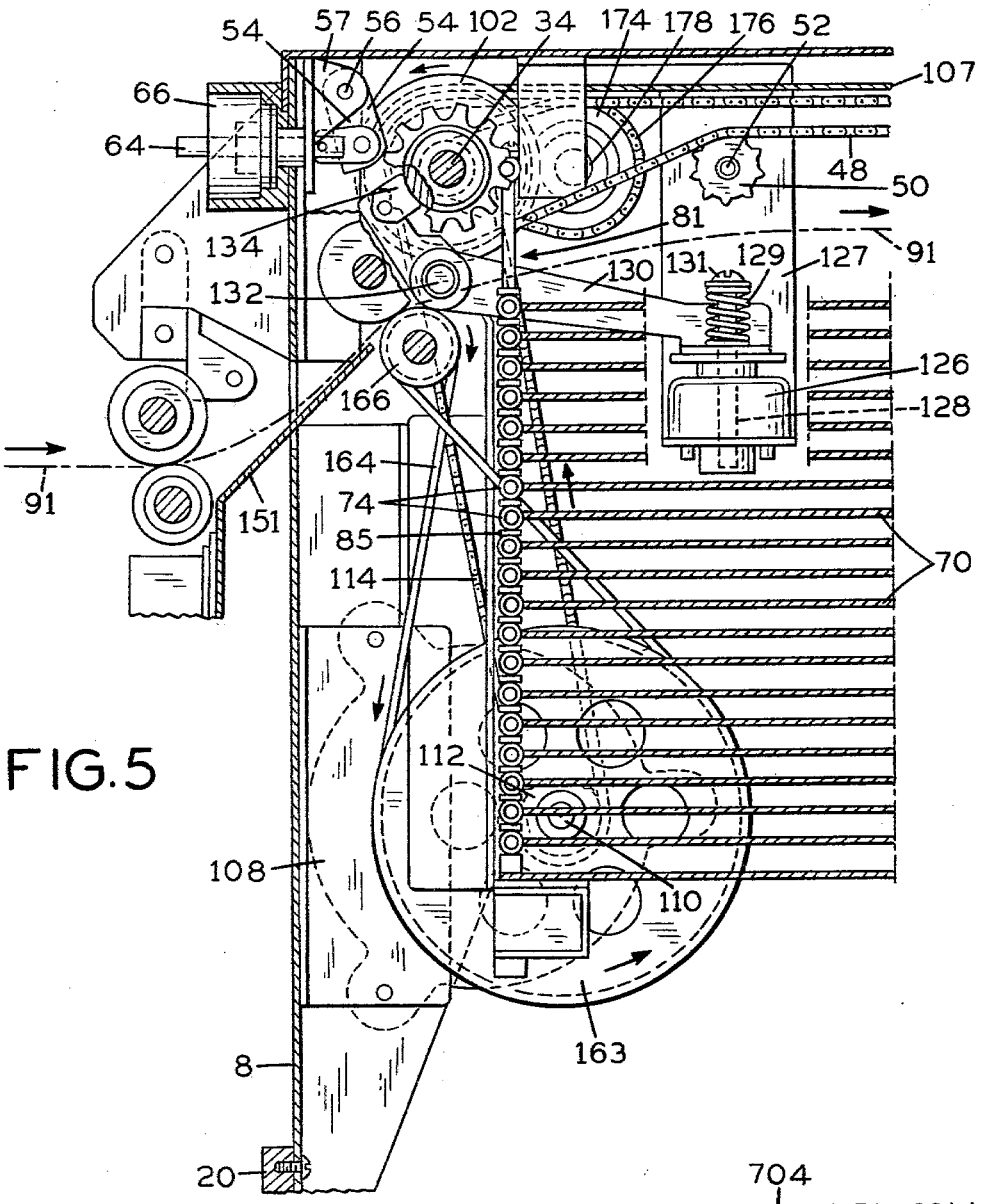
FIG. 5 is a fragmentary vertical sectional view, with parts omitted and parts broken away, illustrating driving mechanism for the sorting apparatus.

The tray-lifting mechanism includes a driving means which will be described with particular reference to FIGS. 4 and 5. When the sorting apparatus is to be put into use, a motor 108 is started and it constantly rotates an output shaft 110 counterclockwise with respect to FIG. 5, as well as FIG. 1. The output shaft 110 of motor 108 has fixed thereon a sprocket 112 which, through a drive chain 114, drives a sprocket 116 (FIG. 4) mounted to rotate as a unit with a driven sleeve 118 journaled for rotation on the rear or outboard end of shaft 34. A clutch drum 120 (FIG. 4) is fixed for rotation with shaft 34. A helical clutch spring 122 wrapped around drum 120 is fixed at one end to sprocket 116 and at the other end is fixed to a clutch disc 124, concentric with but not connected to the drum 120 or shaft 34. The inside diameter of clutch spring 122 is normally greater than that of the clutch drum 120 and thus will not transmit the rotary motion of sprocket 116 to shaft 34 when the clutch parts, described below, are in declutched position. The clutch spring 122 is wrapped clockwise from sprocket 116 to clutch disc 124 and constantly transmits rotation of sprocket 116 to the disc 124.

A clutch-actuating solenoid 126 is supported on a bracket 127 attached to the rear housing plate 4. The plunger 128 of solenoid 126 carries a spring 129 concentric therewith and secured by a screw 131 to bear yieldably upon one end of a clutch arm 130, rockable about the axis of a stub shaft 132 (see FIG. 5) mounted on plate 4. The other end of clutch arm 130 carries a friction shoe 134. When solenoid 126 is energized, plunger 128 will be retracted, causing clutch arm 130 to rock whereby to press the clutch shoe 134 against the periphery of disc 124. The friction of shoe 134, when pressed against the periphery of disc 124, slows the rotation of disc 124 relative to the sprocket 116, thus tightening spring 122 upon the clutch drum 120 and imparting counterclockwise rotation of sprocket 116 to drum 120 and shaft 34 to which the drum is fixed. The resultant rotation of shaft 34 winds cables 106 and 107 upon the drums 102, thus to lift the bottom tray 90 and all of the trays 70 that rest upon it. As trays 70 are lifted, the cylindrical extensions 76 of the corner pins 74 successively pass between the teeth of the four indexing wheels and the adjacent pin guides 78, causing the indexing wheels to rotate counterclockwise, as is permitted by the ratcheting action between pawl 54 and the indexing wheel 24. This process of lifting may be continued until the lowermost tray 70 has been lifted to a position in which its corner pins 74 have become engaged between the teeth of the four indexing or escapement wheels and the adjacent pin guides, at which time the lifting process may be automatically terminated, as now will be described.

Referring now to FIGS. 1 and 1A, a helical compression spring 136 extends downwardly from a spring mounting bracket 138 attached to the inside of housing plate 4. Alto attached to plate 4 is a clutch-controlling limit switch 140 having a downwardly extending actuator 142. As shown in FIGS. 1 and 1A, the limit stop 100, which is fixed to bottom tray 90, includes a portion projecting beneath the spring 136 and an extension 101 extending beneath the limit switch actuator 142. When the trays 70 are being lifted as described above, and before the lowermost of the trays 70 rises to the level of the indexing or escapement wheels, the limit stop 100 comes into contact with and begins to press upwardly upon the compression spring 136. This causes the clutch parts 120 and 122 to slip, thus progressively slowing the speed at which the trays 70 are being lifted. Lifting continues at reducing speed until the portion 101 of limits stop 100 engages the limit switch actuator 142 to open switch 140 and de-energize the clutch solenoid 126 at the moment that the lowermost of the trays 70 becomes engaged by the four indexing wheels. When solenoid 126 is de-energized, the clutch parts 120 and 122 are released, declutching the rotating sprocket 116 from shaft 34. Cable drums 102 and shaft 34 are now free to rotate clockwise (FIG. 1) and the compression spring 136 thereupon is effective to press the limit stop 100, bottom tray 90, and tray frame 81 downwardly for a predetermined distance beneath the lowermost of the trays 70. In this position of the parts, the bottom tray 90 is ready to receive the first sheet to be delivered to the sorting apparatus.

The operation just described is shown diagrammatically in FIG. 1A, wherein in full lines the bottom tray 90 has reached its highest position in which spring 136 is compressed and switch actuator 142 has been moved to "off" position. The resultant declutching of cable drums 104 will thereupon free the bottom tray 90 and tray frame 81 to move downwardly into the dotted-line position of FIG. 1A. FIG. 1B shows the left-hand end of the tray frame 81 and bottom tray 90 in the lowered position, ready to receive the first sheet to be delivered between bottom tray 90 and the lowermost movable tray 70. The latter tray is shown engaged with the indexing wheel 24, ready to drop before the next sheet is delivered or whenever desired upon release of pawl 54. The four corner posts 82 of the cage or inner movable frame 81 are each longer than the total height of all of the trays 70 and spacers 85 when they are stacked in a single stack. This additional length of the corner bars 82 is predetermined in such a manner as to provide the vertical space between the lowermost tray 70 in the upper stack and the bottom tray 90 as shown in FIG. 1B, or the uppermost tray 70 in the lower stack as shown in FIG. 3, as the case may be, between which sheets may be delivered in accordance with the purposes of this invention. In FIG. 1, all of the trays 70 are in the lower stack and a copy sheet 91 is being delivered to the uppermost tray 70 through the vertical space between that tray and the upper cross bars 86 of the frame or cage 81.

Referring now to FIG. 3, it will be noted that the trays 70 in the upper stack, as well as the frame or cage 81 within which they are carried, project for a substantial distance above the level of the chain cover plates 12 and 14 of the housing. For a better understanding of the operation of the sorting device as so far described, it will be assumed, in connection with FIG. 3, that the sorting device is being operated in the collating mode and that it is desired to produce seven collated copies of a multipage document. A copy of the first page of such document has been placed upon the bottom tray 90 and a similar copy has been placed on each of the six successively presented trays 70. It is now time to produce copies of the second page and, for this purpose, the apparatus must be lifted as described above. The lifting cycle is now initiated and the six trays 70 plus the bottom tray 90 are now lifted and the six trays 70 are successively ratcheted through the indexing wheels as described above. This brings the bottom tray 90 up at the level just beneath the teeth of the indexing wheels (see FIG. 1A, full line). This is the moment at which the limit switch 140 is actuated to stop the lifting cycle. At this moment, and with reference to FIG. 3, it will be understood that the upper crossbars 86 of the cage or frame 81 will have been lifted above the level of the uppermost tray 70 by a distance equal to the vertical spacing provided for the reception of delivered sheets. Upon termination of the lifting cycle, the cage 81 and the bottom tray 90, only, will be pushed downwardly by the compression spring 136 (FIG. 1A) into the position shown in FIG. 1B. Such downward movement lowers the upper crossbars 86 back into the position illustrated in FIG. 3 and also places the bottom tray 90 in position to receive the first copy of the second page of the document being printed and collated. After the copy has been placed on tray 90, the indexing wheels are released for one increment of rotation thus to release the lowermost of the trays 70 in the upper stack. As this lowermost tray drops down to a level to receive a sheet, the entire upper stacks drops by one increment of spacing between trays, permitting the cage to move downwardly for this distance and lowering the bottom tray 90 by a single increment, as will be understood. In this example chosen for illustration, these steps will be replaced for the lowering of five additional trays 70. After all seven copies of the second page have been deposited on the respective trays, the device is ready for a repetition of the lifting operation described hereinabove.

It is a particular advantage of the present invention that the sorting apparatus will accommodate oversize stacks of collated or otherwise sorted sheets. This flows from the fact that the trays 70 are individually movable vertically within the inner cage or frame 81 and this is in contrast with those of the prior-art sorting devices wherein bins are made up of vertically spaced shelves, or the like, which have a fixed vertical relationship with one another. Referring again to FIG. 3, it will be observed that the normal vertical spacing between the trays 70 is established by the spacing rings 85 which are strung upon the vertical rods 82 between adjacent pairs of trays 70. The spacing thus established may be arbitrarily selected to accommodate what might be regarded as the normal maximum number of sheets which each tray is to receive. For example, the machine may be so laid out as to accommodate, say, twenty or thirty or forty or more sheets in each tray as permitted by the spacing established by the spacing rings 85. However, the user of the machine may occasionally have to deal with multipage documents having a somewhat greater number of sheets destined for each stack. In such event, the excess sheets will pile above the level of the top of the rings 85, and as each tray 70 is dropped upon such a stack, it will rest upon the top sheet of the oversize stack. As a result of this, the accumulated height of the overloaded trays 70 in the lower stack, as viewed in FIG. 3, will be greater than that shown in that figure. Resultantly, the particular tray which is positioned for deposit of a sheet will lie somewhat above the level shown in FIG. 3. As will be described hereinbelow, the sheet-delivering rollers of the present device are so arranged as to accommodate a reasonable number of additional sheets in each stack whereby the newly deposited sheet will not jam or otherwise become tangled. In other words, the vertical spacing between upper and lower stacks establishing the area within which the sheets are to be delivered is made somewhat oversize in the first place and, within limits, the total height of the lower stack may rather substantially exceed the minimum height which is shown in FIG. 3.

Referring now to FIG. 1, it will be observed that the photocopier machine 1 is provided with a conventional pair of sheet-output rollers 150 which, in the absence of the apparatus of the present invention, serve to deliver individual sheets in a convenient manner for retrieval by the operator of the machine. For example, a guide plate 151, which is conventionally mounted in the copying machine, includes an angular surface which starts generally within the plane of delivery of the output rolls 150 of the copier and serves to deflect each successive sheet upwardly and angularly as it emerges from the copier.

The sorting apparatus of the present invention includes a top roller shaft 154 and a bottom roller shaft 158, both journaled at their opposite ends in plates 2 and 4 of the housing of the sorting device. Shaft 158 is provided with feed rollers 160 and shaft 154 is provided with feed rollers 156 (see FIGS. 2 and 3). As will be apparent from FIG. 1, the paper guide 151 serves to feed photocopies 91 successively from the photocopier rollers 150 into the nip between the feed rollers 156 and 160. The feed rollers 156 and 160 are driven constantly during operation of the device by apparatus shown particularly in FIG. 5. In that figure, it will be observed that the shaft 110 of motor 108, which rotates counterclockwise, carries a pulley 163 of relatively large diameter around which is threaded a flexible belt 164. The belt 164 is twisted through 180 degrees so as to drive a pulley 166 (also see FIG. 3) fixed upon the shaft 158 in a clockwise direction. Thus, the feed rolls 156 on shaft 158 become the driving rolls, whereas the feed rolls 160 mounted on the shaft 154 serve as idler rolls cooperating with the driven feed rolls 156 to feed sheets of paper as viewed in FIG. 1 or FIG. 5. In FIG. 1, a sheet 91 is shown partially delivered by the rolls 160 and 154 into the sorting apparatus to land upon the uppermost tray 70.

The bottom tray 90, as well as all of the individual trays 70, preferably have lateral and longitudinal dimensions which are at least great enough to accommodate the largest sheet of paper which is expected to be delivered from the sheet-delivering apparatus with which this sorter is to be associated. Therefore, in order that sheets of smaller size may be stacked on the trays in a relatively neat fashion, it is preferable that suitable end and side guide devices be provided to limit the area within which an incoming sheet 91, for example, may move after being delivered to a tray. To avoid undue complication of the disclosure herein, typical lateral guides are shown but not described, it being understood that such devices are well known in the art. However, since the present invention provides individually movable trays, it is preferable that end guides—that is, the guides which determine length of the travel of the sheets into the sorting mechanism—be designed as a quickly adjustable unit as distinguished, for example, from providing individual end guides for each of the several trays 70. To this end, as shown most clearly in FIG. 2, an end guide 168 is provided. This comprises a plate secured beneath the lower surface of the bottom tray 90, and the bottom tray 90, as well as all of the superimposed trays 70, are provided with openings 169 through which vertical extensions of the end guide 168 extend (also see FIG. 1). The lower portion of the end guide 168 is in the form of a plate, suitably slotted as shown at 168A and arranged with an accessible extension 168B by which it may be moved longitudinally—that is, left to right as viewed in FIG. 2—to position the upward extensions of plate 168 where desired for use with sheets of varying sizes.

My sorting apparatus is provided with mechanism for successively and individually dropping trays 70 from the upper stack in selected timed relation with the delivery of sheets to the sorting apparatus. As shown particularly in FIG. 4, a drive sprocket 170 is secured for rotation with the sleeve 118, which is constantly driven in a counterclockwise direction during the operation of my apparatus by sprocket 116 (see FIG. 5). A drive chain 172 (see FIG. 4) connects sprocket 170 with a driven sprocket 174 mounted for rotation with a driven sleeve 176 journaled about a governor shaft 178. Sprocket 174 is larger in diameter than sprocket 170 whereby sprocket 174 rotates at a lower angular velocity than sprocket 170. The governor shaft 178 is journaled between housing plate 4 and an extension of the solenoid mounting bracket 127. A governor clutch drum 180 is secured for rotation with the governor shaft 178 and is surrounded by a helical governor spring 182 fixed at one end to driven sleeve 176. Sleeve 176 and spring 182 rotate constantly in counterclockwise direction and cooperate with the drum 180 to govern the speed at which the index wheels are permitted to rotate to release the trays 70. To this end, the spring 182 which has one end fixed to the driven sleeve 176 is free at its opposite end, and it is wound counterclockwise around clutch drum 180 with the coils normally in frictional contact with the surface of that drum. Thus, when sleeve 176 rotates counterclockwise, spring 182 frictionally engages drum 180 in the unwinding direction of the spring, but nevertheless constantly and yieldably urges the drum 180 to rotate counterclockwise. When shaft 178 is prevented from rotating counterclockwise, the spring 182 tends to unwind and slips relative to the drum 180, thus permitting sleeve 176 and spring 182 to continue rotation independently of the drum 180 and shaft 178. On the other hand, if drum 180 and shaft 178 attempt to rotate counterclockwise at a speed in excess of that of the sleeve 176 and spring 182, spring 182 tightens around, and grabs, the drum 180 holding it to the speed of rotation of the sleeve 176.

A small gear 184 (see FIG. 3) is fixed upon the end of a shaft 178 and is in mesh with a larger gear 186. Gear 186 is fixedly mounted on the sprocket 32 and thus is rotatable in unison with all four of the indexing wheels 22, 24, 26, and 28. The constant yielding pressure of spring 182 upon drum 180 tends to rotate gear 184 counterclockwise, which tends, in turn, to rotate gear 186 and sprocket 32 clockwise. But, since gear 186 is fixed through sprocket 32 to the indexing wheel 24, and since the pawl 54 (see FIG. 1) normally prevents the clockwise rotation of wheel 24, gears 186 and 184 normally cannot rotate, and spring 182 normally slips in frictional engagement with the drum 180.

As described above, the cage 81 and all of the trays 70 in the upper and lower stacks therein are supported by the four indexing wheels 22, 24, 26, and 28. The combined weight of the cage and trays, plus sheets 91 accumulated on the trays tends under influence of gravity to rapidly rotate the indexing wheels clockwise when pawl 54 is disengaged from the indexing wheel 24. However, since spring 182 and related parts of the governoring mechanism just described hold clockwise rotation of the indexing wheels to a fixed speed, the cyclic rate at which trays 70 fall from the indexing wheels is fixed. Therefore, it is made possible to accurately control the number of trays which successively fall by controlling the length of time that pawl 54 is disengaged from the index wheel 24. The trays may be dropped one at a time by supplying short current pulses to solenoid 66, or they may be dropped successively in any desired number at the predetermined cyclic rate by supplying a longer current pulse to the solenoid 66.

As each successive tray 70 is dropped, the height of the upper stack will be reduced by the thickness of that tray, while the height of the lower stack will be increased by this same amount. The cage 81 also will drop by the same distance with the dropping of each tray 70. Resultantly, the width of the gap between the lowermost tray of the upper stack and the uppermost tray of the lower stack is relatively constant and sufficient for receipt of the copies successively delivered from the sheet-delivering apparatus.

After the topmost tray 70 in the upper stack has been dropped, the extensions 88 of bars 86 at the top of the cage 81 become engaged between the teeth of the indexing or escapement wheels and the adjacent pin guides. The extensions 88 of the bars 86 are longer than the extensions 76 on the corner pins of the trays 70. This additional length of the bars 88 prevents them from being dropped from the teeth of the indexing or escapement wheels.

For this purpose, each of the pairs of pin guides 78 is provided with a hook member 188 adapted to catch and hold the longer extensions 88 of upper cross bars 86 of cage 81 when they enter the indexing wheels, but to permit the shorter extensions 76 of corner pins 74 to pass through as the trays 70 are being dropped. As best shown in FIGS. 3 and 4, each pin guide 78 has secured thereto a spacer 190 supporting a hook member 188 having a hook surface 189 positioned outside the vertical path of the shorter extensions 76 but within the path of the longer extensions 88. As shown in FIG. 4, the shorter extensions 76 are free to drop past the hook surfaces 189, whereas in FIG. 2 the longer extensions 88 of bars 86 are shown resting upon those hook surfaces, thus holding bars 86 in the position shown in FIG. 1.

Operations of the clutch solenoid 126 and of the drop solenoid 66 preferably are controlled by electronic circuits such as shown in FIGS. 6, 7, 8, and 9. The inputs which control these circuits come either from a control panel or from the copier or other sheet-delivering apparatus with which the device of the present invention is associated.

The exterior of a control panel 201 is shown in FIG. 4, where it is attached to the sorter. In the event the sorter is built integrally with the copier, this control panel may be grouped with the copier controls. The panel 201 comprises an on-off switch 202, collate switch 204, stack switch 206, and single-step switch 208. The control panel also includes two indicator lights, a collate mode indicator light 210, and a stack mode indicator light 212. The on-off switch 202 permits an operator to switch the sorting apparatus between an ON mode, in which it either stacks or collates as selected, and an OFF mode, in which it merely receives photocopies in the tray which is in position to receive such copies. The on-off switch 202 is a mechanically locking push-button switch; that is, once it is pushed down, it stays down until pushed again to unlock it. When up, the switch 202 directs a high voltage to an OFF line. When down, it directs a low voltage to the OFF line. The collate mode switch 204 permits the operator to switch the apparatus from the stack mode to the collate mode as may be desired. The collate mode switch 204 is a monostable push button, switching a high voltage to a COLLATE line when pushed and directing a high voltage to the NEG-COLLATE line when not pushed. Stack button 206 permits the operator to switch the apparatus from the collate mode to the stack mode. It also is a monostable push button. When pushed, it switches a high voltage to a stack line, and when not pushed, it directs a high voltage to a NEG-STACK line. The single-step switch 208 permits the operator to drop one tray at a time while the apparatus is in the stack mode. It also is a monostable push button. When pushed, the switch 208 directs a high voltage to a SINGLE-STEP line. When not pushed, the single-step switch 208 directs a low voltage to the SINGLE-STEP line.

There are three signal inputs supplied to my apparatus from copier 1. The first is the START line. In order to make a given number of copies of a given page, an operator places that page on the platen of copier 1, sets a copy number dial to the given number of copies desired, and pushes a start button (not shown) on the copier—not to be confused with the ON-OFF switch 202 described above. Thereupon copier 1 starts to automatically produce the indicated number of copies of the given page. The voltage of the START line goes high only once during the process of producing the given number of copies, for a brief period immediately after the start button is pushed. The second input from copier 1 to my apparatus is the PAPER EXIT line. A small paper exit switch (not shown) is placed near output rollers 150 of copier 1. A feeler attached to this switch senses the passing of a photocopy 91 near these rollers. The feeler causes the PAPER EXIT line to go high when a photocopy 91 first starts to pass through rollers 150 and causes that line to go low once the trailing edge of that photocopy leaves rollers 150. The third signal input from copier 1 to my apparatus is the PAPER JAM line. It goes high and stays high as long as copier 1 senses a jam in its paper path.

All of the electronic signal inputs which control my sorting apparatus are passed through debouncing circuits (not shown), of a type well known in the electronic arts, before being fed into the control circuitry shown in FIGS. 6, 7, 8, and 9. The debouncing circuits remove unwanted noise from these inputs, preventing undesirable results in the operation of my apparatus.

Figure 6:
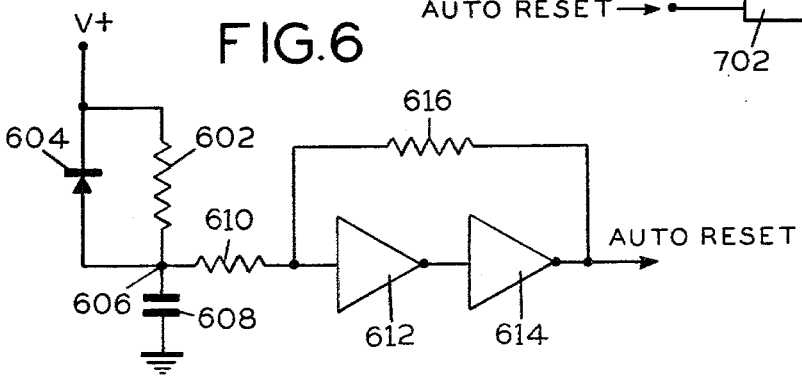
FIG. 6 is a schematic view of an automatic reset circuit for the sorting apparatus.

FIG. 6 shows circuitry for generating an AUTO RESET signal. Resistor 602 and a diode 604 are connected in parallel between a positive voltage supply and node 606. Diode 604 limits the positive voltage of node 606 to that of the positive voltage supply. Capacitor 608 is connected between node 606 and ground, and resistor 610 is connected between node 606 and the input of a gate or inverter 612. The output of inverter 612 is the input of a gate or inverter 614, and the output of inverter 614 is connected to the AUTO RESET line and to resistor 616, the other end of which connects to the input of inverter 612. When electric power is first supplied to the circuitry of my apparatus by pushing ON-OFF switch 202 (FIG. 4) to ON position in which it mechanically locks, node 606 is pulled low by its coupling through capacitor 608 to ground. As a result, the input through resistor 610 to inverter 612 is low, causing the input to inverter 614 to be high and the output of inverter 614 and the AUTO RESET line to be low. This low output is fed back through resistor 616 into inverter 612, reinforcing the tendency of gates 612 and 614 to keep the AUTO RESET line low. But after power has been on for a brief period, node 606 is raised by charge conducted through resistor 602 to a voltage sufficient to bring the input of inverter 612 high. Once this happens, the output of gate 612 goes low, causing the output of gate 614 to go high. The high output of gate 614 sets the AUTO RESET line high and passes back through resistors 616 to the input of gate 612, tending to stabilize the high output of the AUTO RESET line. In my preferred embodiment, the value of resistor 602 and capacitor 608 causes a time delay of about 0.05 second after power is turned on before the AUTO RESET line goes high.

Figure 7:
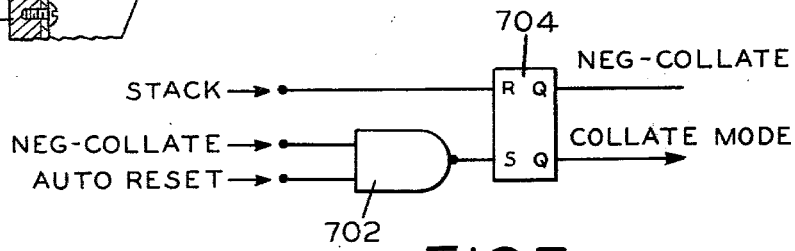
FIG. 7 is a schematic view of a collate flip-flop circuit for the sorting apparatus.

FIG. 7 shows the circuitry for determining whether by apparatus operates in the collate mode or the stack mode. The AUTO RESET line and the NEG-COLLATE line are both connected as inputs to NAND gate 702. The output of that gate is the set input of flip-flop 704. The STACK line is the reset input of flip-flop 704. The positive output of flip-flop 704 is the COLLATE MODE line and its negative output is the NEG-COLLATE line. Flip-flop 704 is set when power is first turned on, because the AUTO RESET line is low at that time, and thus the output of NAND gate 702 is high. Flip-flop 704 stays set until stack switch 206 is pushed, causing the STACK line to go high, resetting that flip-flop. The flip-flop remains reset until collate switch 204 is pushed, at which time the COLLATE line goes low and the output of NAND gate 702 goes high. Thus, the COLLATE MODE line is set high when my apparatus is first turned on. Once set high, the COLLATE MODE line stays high until stack button 206 is pushed; and once the stack button is pushed, the COLLATE MODE line goes low and stays low until the operator pushes collate switch 204, at which time the COLLATE MODE line is once again set high. Among other things, a high voltage on the COLLATE MODE line turns on light 210, indicating that my apparatus is in the collate mode. The NEG-COLLATE line is high-voltage whenever the COLLATE MODE line is low-voltage, and vice versa. A high potential on the NEG COLLATE line turns on light 212, indicating that my apparatus is in the stack mode.

Figure 8:
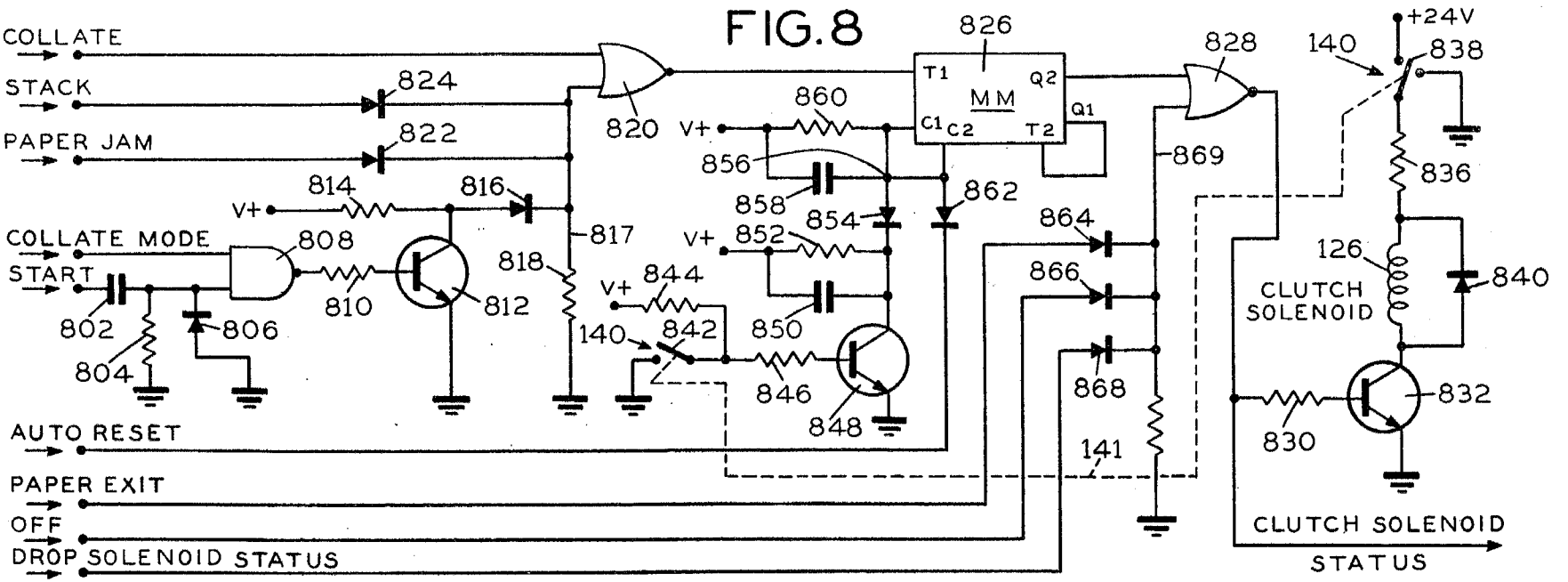
FIG. 8 is a schematic view of a clutch solenoid control circuit for the sorting apparatus.

FIG. 8 shows the circuitry for controlling the operation of clutch solenoid 126. The START line is connected through capacitor 802 to resistor 804, the cathode of diode 806, and one input of NAND gate 808. Resistor 804 and diode 806 are both connected to ground, and the other input of NAND gate 808 is the COLLATE MODE line. The output of NAND gate 808 is connected through resistor 810 to the base of transistor 812. The emitter of transistor 812 is connected to ground, and its collector is connected both through a resistor 814 to a positive voltage supply and through the anode of diode 816 to line 817. Line 817 is connected by resistor 818 to ground and to one input of NOR gate 820.

In operation, capacitor 802, resistor 804, and diode 806 operate as a rising edge detector, feeding a brief positive pulse to NAND gate 808 when the START line swings from a low to a high voltage. When my apparatus is in the collate mode, the COLLATE MODE line is constantly high, and thus a positive transition on the START line causes NAND gate 808 to have a brief low output. This low output passes through resistor 808 to the base of transistor 812, turning that transistor off, pulling the input of diode 816 high through resistor 814, and supplying a high voltage to line 817 and the input of NOR gate 820.

NOR gate 820 has three other inputs. The PAPER JAM line is connected through the anode of diode 822 and line 817 to NOR gate 820. Similarly, the STACK line is connected through the anode of diode 824 and line 817 to NOR gate 820. The COLLATE line is directly connected to the other input of NOR gate 820. The output of NOR gate 820 goes low whenever any of its inputs goes high. Thus, if the collate button is pushed, if the stack button is pushed, if there is a paper jam, or if during the collate mode the start button is pushed, NOR gate 820 goes low.

The output of NOR gate 820 is the first trigger input of dual stage monostable multivibrator 826. Multivibrator 826 is wired so that both its trigger inputs are activated by a falling edge. The positive output Q1 of the first stage of multivibrator 826 is the trigger input of the second stage of that multivibrator, and the negative output Q2 of the second stage is one input of NOR gate 828. The output of NOR gate 828 is connected to the CLUTCH SOLENOID STATUS line and through resistor 830 to the base of transistor 832. The emitter of transistor 832 is connected to ground, and its collector is connected serially through clutch solenoid 126, resistor 836, and throw 838 of limit switch 140 to the +24 volt power supply. Diode 840 is connected in parallel with clutch solenoid 126, its anode being connected to the collector of transistor 832. When NOR gate 820 goes low, it triggers the first stage of multivibrator 826. This causes output Q1 to go high briefly and then return low. The return of Q1 to a low voltage triggers the second stage of the multivibrator, causing Q2 to go low for a relatively long period of time. Unless the input line 869 to NOR gate 828 is high, the low voltage of Q2 causes NOR gate 828 to go high, bringing the CLUTCH SOLENOID STATUS line and the base of transistor 832 both high. This high voltage turns transistor 832 on, causing current to flow through solenoid 126, resistor 836, and throw 838 if switched to the +24 volt source. The current through solenoid 126 causes tray frame 81 and trays 70 to be lifted. This lifting process continues until limit stop 100 presses against actuator 142 of limit switch 140.

As shown in FIG. 8, the limit switch 140 contains two throws mechanically ganged as indicated by broken line 141 for sequential opening when the limit stop 100 engages the switch actuator 142 (FIGS. 1 and 1A). A throw 838 normally contacts the +24 volt supply while a throw 842 normally contacts ground. The limit switch 140 is built so that actuator 142 first opens throw 842 and must be pushed further to open throw 838. When the lifting of frame 81 pushes limit stop 100 against actuator 142, normally only 842 is disconnected, removing current from solenoid 126 (as is described in greater detail below) and stopping the further lifting of frame 81; but if, for some reason, the opening of throw 842 fails to stop the lifting of frame 81, the resultant continued pushing of stop 100 against actuator 142 will disconnect throw 838 from the +24 volt supply and connect it with ground to further assure de-energization of solenoid 126.

Lifting of all of the trays 70 and frame 81 from the position of FIG. 1 to the position of FIG. 1A is accomplished preferably in less than one second. The duration of the low output from the second stage of multivibrator 826 is only slightly longer than the amount of time normally required to lift all the trays. Thus, current through solenoid 126 will be turned off by multivibrator 826 shortly after all the trays have been lifted, even if, for some reason, throws 838 and 842 both fail to do so. Diode 840 prevents a large voltage spike from being induced when solenoid 126 is turned off.

The first stage of the monostable multivibrator 826 provides a brief delay between the falling output of NOR gate 820 and the activation of clutch solenoid 126. This delay separates the surge of power consumption caused by the operation of clutch solenoid 126 and the lifting of trays from the surge of power consumption caused by the pushing of the start button and the accompanying start of a copy cycle in the copier 1.

It can be seen that my control circuit normally causes clutch solenoid 126 to initiate the lifting of trays upon the pushing of the collate button 204, upon the pushing of the stack button 206, upon the receipt of a paper jam signal, or upon the pushing of the start button of the copier 1 during the collate mode. There are, however, a series of conditions which prevent these events from initiating the operation of the clutch solenoid 126. One such condition occurs when limit stop 100 breaks the connection of throw 842 with ground. Throw 842 is connected by resistor 844 to a positive voltage supply and by resistor 846 to the base of transistor 848. The emitter of transistor 848 is connected to ground, and its collector is connected to capacitor 850, resistor 852, and the cathode of diode 854. Capacitor 850 and resistor 852 are both connected to a positive voltage supply. The anode of diode 854 is connected to a common node 856, which, in turn, is connected through capacitor 858 and a resistor 860 to the positive voltage supply and to the clearing inputs C1 and C2 of both stages of multivibrator 826. Normally throw 842 is connected to ground, turning transistor 848 off; but when limit stop 100 breaks the connection of throw 842 with ground, the base of transistor 848 is pulled high through resistors 844 and 846, turning that transistor on and causing a voltage drop across resistor 852. This voltage drop pulls the cathode of diode 854 low, causing current to flow through resistor 860, node 856, and diode 854. The resultant voltage drop across resistor 860 pulls the clearing inputs C1 and C2 of the multivibrator 826 low. While these clearing inputs are low, neither stage of the multivibrator can respond to any trigger and Q2 output of the multivibrator is brought high. Thus, when stop 100 disconnects throw 842 from ground, solenoid 126 is turned off and multivibrator 826 cannot be triggered.

Another condition which inhibits the operation of solenoid 126 is a low voltage on the AUTO RESET line. The AUTO RESET line is connected to the cathode of diode 862. The anode of this diode is connected through node 856 to the clearing inputs C1 and C2 of both stages of multivibrator 826. The AUTO RESET line is low only during the first fraction of a second after power is supplied to the control circuit. When the line is low, its connection to diode 862 prevents the triggering of multivibrator 826 and thus prevents the operation of clutch solenoid 126. Thus, the AUTO RESET line prevents the multivibrator from accidentally triggering the lifting of trays during the brief period of electronic instability that accompanies the turning on of my control circuit.

The three other conditions inhibiting the operation of solenoid 126 are a high voltage on the PAPER EXIT line, a high voltage on the OFF line, and a high voltage on the DROP SOLENOID STATUS line. Each of these three lines is connected through the anode of a diode 864, 866, and 868, respectively, to input line 869, which is connected by resistor 870 to ground and to one input of NOR gate 828. Whenever one of these inhibitory lines is high, NOR gate 828 is kept low and clutch solenoid 126 remains off.

Figure 9:
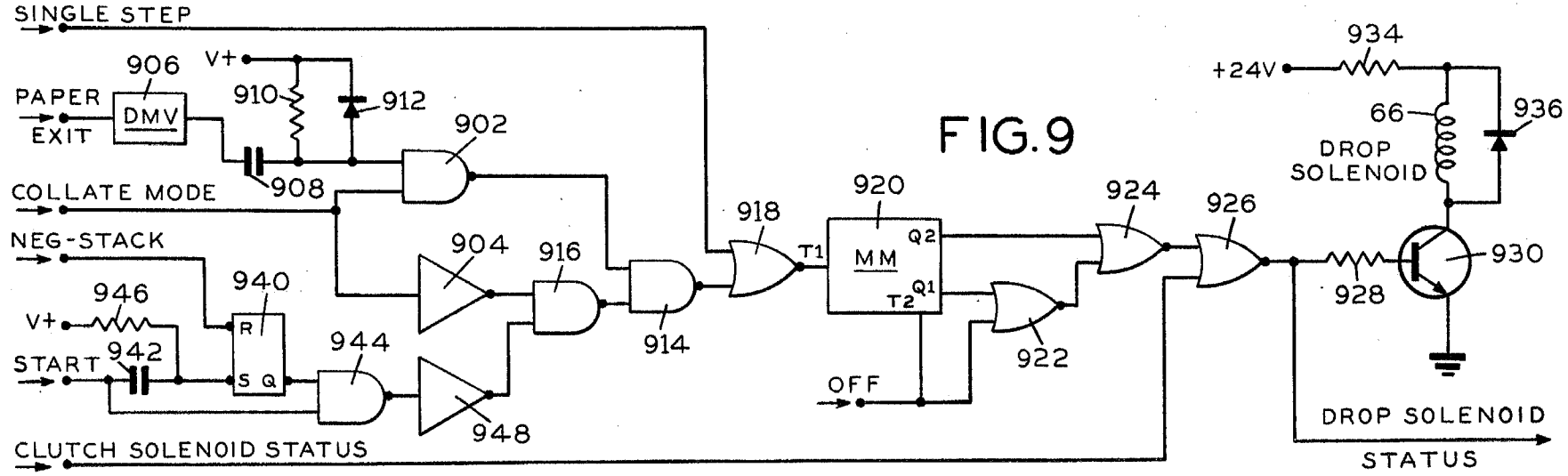
FIG. 9 is a schematic view of a drop solenoid control circuit for the sorting apparatus.

FIG. 9 shows the circuit for controlling the operation of drop solenoid 66. This circuit has three basic modes of operation: the collate mode, the stack mode, and the off mode.

During the collate mode, the COLLATE MODE line is always high. This line is connected to an input of a NAND gate 902 and to an inverter 904. The PAPER EXIT line is connected to the input of a delay monostable multivibrator 906. The output of multivibrator 906 is connected through capacitor 908 to resistor 910, the anode of diode 912, and an input of NAND gate 902. The other ends of resistor 910 and diode 912 are connected to a positive voltage supply. Multivibrator 906 is triggered by a transition from high to low on the PAPER EXIT line. Such a falling edge occurs when a photocopy 91 exits from the copier 1. The falling edge produces a brief positive pulse from the delay monostable multivibrator. Capacitor 908, resistor 910, and diode 912 operate as a falling edge detector, feeding a brief negative input to NAND gate 902 when the positive output of multivibrator 906 ends. Thus, during the collate mode, the output of gate 902 goes high for a brief period shortly after each exit of a photocopy from the copier 1.

The output of NAND gate 902 is connected to one input of a NAND gate 914. The other input to NAND gate 914 is the output of a NAND gate 916, which has as one of its inputs the output of inverter 904. During the collate mode, the input to inverter 904 is always high, causing NAND gate 916 to remain high and the output of NAND gate 914 to be the inverse of the output of NAND gate 902.

The output of NAND gate 914 is one input to NOR gate 918. NOR gate 918 triggers the first stage of a double stage monostable multivibrator 920. The negative output Q1 of the first stage of that multivibrator is one input to NOR gate 922, the output of which is one input to NOR gate 924. The output of NOR gate 924 is one input to NOR gate 926, and the output of NOR gate 926 is connected to the DROP SOLENOID STATUS line and through resistor 928 to the base of transistor 930. The emitter of transistor 930 is connected to ground, and its collector is connected through solenoid 66 and resistor 934 to the +24 volt line.

Thus, shortly after the exit of a photocopy 91 from copier 1, a brief positive pulse exits from NAND gate 902, causing a brief negative pulse to exit from NAND gate 914, which, in turn, normally causes a brief positive pulse to exit from NOR gate 918, unless the other input to NOR gate 918 is high. The first stage of multivibrator 920 is triggered by the falling edge of the brief positive pulse produced by NOR gate 918, causing Q1 to go low. This sets NOR gate 922 high, unless my apparatus is in the off mode. When NOR gate 922 goes high, NOR gate 924 goes low, setting NOR gate 926 high, unless the CLUTCH SOLENOID STATUS line is high. When NOR gate 926 is high, the DROP SOLENOID STATUS line goes high, inhibiting the operation of clutch solenoid 126, and transistor 930 and drop solenoid 66 are turned on. The Q1 output of multivibrator 920 remains low for only ten milliseconds. This causes solenoid 66 to be on, and pawl 54 to be disengaged from escapement wheel 24, long enough for one, and only one, tray 70 to be dropped. Diode 936 is connected across solenoid 66 to prevent a large voltage spike from being induced when solenoid 66 is turned off.

It can be seen that, during the collate mode, my apparatus drops one tray 70 from above to below the paper output path shortly after a photocopy 91 exists from copier 1. The delay caused by multivibrator 906 allows a photocopy 91 time to pass between feed rolls 156 and 160 and be placed upon the topmost tray of the lower stack before the next tray is dropped. It can also be seen that, during the collate mode, the input to NOR gate 918 from NAND gate 914 is always high, except briefly after a falling edge on the PAPER EXIT line. As a result, during the collate mode, the SINGLE STEP line, which is one input of NOR gate 918, has no effect.

The second mode of operation of the circuit shown in FIG. 9 is the stack mode. The stack mode is initiated by pushing stack button 206 (FIG. 4). This resets flip-flop 704 (FIG. 7), causing the COLLATE MODE line to remain low as long as my apparatus stays in the stack mode. As a result, one input of NAND gate 902 remains low, keeping that gate and its input to NAND gate 914 high. Similarly, the input to inverter 904 remains low, and thus its input to NAND gate 916 remains high.

The NEG-STACK line (FIG. 9) is connected to the negatively triggered reset input R of flip-flop 940. The START line is connected both to capacitor 942 and to input of NAND gate 944. The other end of capacitor 942 is connected through resistor 946 to a positive voltage line and to the negatively triggered set input of flip-flop 940. The Q output of flip-flop 940 is the other input to NAND gate 944, and the output of NAND gate 944 passes through inverter 948 to one input of NAND gate 916. When my apparatus is set to the stack mode by pushing stack button 206, the NEG-STACK line goes low, resetting flip-flop 940, setting low its output to NAND gate 944. Thus, the first time the start button of the copier is pushed after my apparatus is set to the stack mode, the resultant positive pulse on the START line has no effect upon NAND gate 944. Upon the termination of that first positive pulse, however, capacitor 942 and resistor 946, which operate together as a falling edge detector, feed a negative pulse to the set input of flip-flop 940, setting the Q output of that flip-flop high. As a result, as long as my apparatus remains in the stack mode, all subsequent positive pulses on the START line will cause NAND gate 944 to go low. Each low output of NAND gate 944 causes inverter 948 to go high, NAND gate 916 to go low, and NAND gate 914 to go high. When NAND gate 914 goes high, NOR gate 918 goes low, triggering the first stage of multivibrator 920 and causing drop solenoid 66 to be energized for ten milliseconds. Thus, after the stack mode is selected, each time the start button of the copier 1 is pushed, except for the first, one tray 70 is dropped from above to below the paper output path.

During the stack mode, NAND gate 914 normally has a low output. In FIG. 9, the SINGLE STEP line is connected to an input of NOR gate 918. Thus, pushing single step button 208 (FIG. 4) normally causes a falling edge in the output of NOR gate 918, triggering the first stage of multivibrator 920 and causing one tray 70 to fall from the indexing wheels.

The third mode of operation of the circuitry shown in FIG. 9 is the off mode. When my apparatus is set to the off mode by the release of on-off switch 202 (FIG. 4), the resultant high voltage on the OFF line inhibits the operation of NOR gate 922 and prevents the first stage of multivibrator 920 from activating solenoid 66. Thus, while my apparatus is in the off mode, drop solenoid 66 cannot be activated by a paper exit or the pushing of the start or single step buttons. The OFF line is also connected to the trigger input of the second stage of multivibrator 920, which is triggered by a rising edge. When the operator releases the on-off button, the OFF line goes high, triggering the second stage of multivibrator 920 and causing its output Q2 to go high for approximately one second. The Q2 output is an input of NOR gate 924, and when it goes high, NOR gate 924 goes low. This low output sets NOR gate 926 high, activating drop solenoid 66, unless the CLUTCH SOLENOID STATUS line, which is connected to an input of NOR gate 926, is high. Thus, when an operator first turns my apparatus to the off mode, drop solenoid 66 removes pawl 54 from drop wheel 24 for approximately one second, allowing time for all trays 70 to drop below the paper output path of feed rolls 156 and 160.

It can be seen that my sorting apparatus, as illustratively shown and described herein, has three basic modes of operation, the first being the off mode. As described immediately above, when the off mode is first chosen, all trays 70 fall to below the paper output path. This causes all photocopies subsequently output from copier 1 to fall upon the top tray of my apparatus in an unsorted, uncollated fashion. Except for this initial dropping of trays, clutch solenoid 126 and drop solenoid 66 remain totally inactive during the off mode because of the inhibitory effect of the OFF line on NOR gates 828 and 922.

The second basic mode of operation is the collate mode. When this mode is first chosen by pushing collate button 204, the COLLATE line goes high, causing NOR gate 820 to trigger clutch solenoid 126, lifting all trays 70 through the index wheels to the position shown in FIG. 1B and leaving only bottom tray 90 below the paper output path. During the time that the collate mode remains in effect, all trays 70 are lifted each time the start button of the copier 1 is pushed and NAND gate 808 goes low. After each photocopy 91 exiting from copier 1 has had time to be propelled onto the uppermost tray of the lower stack, a delayed signal from the monostable delay multivibrator 906 causes solenoid 66 to drop a tray from the upper stack, so that the next photocopy exiting copier 1 will land on that most recently dropped tray. This process is repeated for each of up to twenty copies of a given page, so that each copy is placed in a successive tray, starting with bottom tray 90. Then, if a multipage original is being collated, the operator places a different page on the platen of copier 1 and pushes the start button. The resultant high on the START line triggers NAND gate 808, causing solenoid 126 to rapidly lift all trays except tray 90 above the paper output path. Each copy of this different page is then placed on a successive tray of my sorting apparatus, starting with tray 90, owing to the successive dropping of trays in response to the successive triggering of multivibrator 906. If this process is repeated for each page of the multipage original, in reverse order, a collated copy of the original will be placed on successive trays of my sorting apparatus. For example and with reference to FIG. 3, if seven copies are to be made of a five-page original document, the following procedure should be followed: The operator should set my sorting apparatus to the collate mode. He should then set the copy number dial on copier 1 to seven copies. He should then place page 5 of the original document on the platen of copier 1 and push the start button. As a result, one copy of the fifth page will be placed on each of the lower seven trays of my sorting apparatus and the trays will be in the position shown in FIG. 3. The operator should then repeat this process for all prior pages of the original, copying the highest-numbered pages first. After this is completed, the lower seven trays of my sorting apparatus will each contain a collated copy of the five-page original document.

The third basic mode of operation is the stack mode. When my apparatus is set to this mode by pushing stack button 206, the high input of diode 824 turns on clutch solenoid 126, lifting all trays except tray 90 above the paper output path. Each subsequent time the start button of the copier 1 is pushed, except the first, the output of NAND gate 944 causes solenoid 66 to drop one tray. As a result, each set of copies produced by a separate pushing of the start button is placed on a separate tray. No tray is dropped after the first pushing of the start button because tray 90 is already positioned at that time to receive photocopies. The combination of pushing stack button 206 to lift trays 70 and pushing single step button 208 to drop these trays one-by-one allows the operator to place any desired tray in position to receive the next photocopy 91 exiting copier 1.

The control circuitry of my apparatus has been diagrammatically illustrated, and it will be understood that different specific components and wiring known in the art may be used to achieve the same or equivalent results. Also, it will be understood that suitable alarm and shut-down devices may be added as desired for safety and convenience, for example, in the event the copier-paper supply runs low or out, or in other undesirable events.

It will be seen that I have accomplished the objects of my invention. I have provided a simple and inexpensive sheet-sorting apparatus which is compact in size and which is capable of collating as well as other forms of sorting. My sheet sorter allows considerable flexibility as to the number of sheets which may be placed between trays, and it receives sheets between parallel trays, so as not to pinch the sheets it receives. My sorting apparatus relies largely upon gravity for the dropping of trays and uses little energy. It also has a short paper path, which reduces the likelihood of jamming, and it maintains a fairly constant vertical space in the sheet-receiving gap between trays, decreasing the likelihood that papers fed into that gap will jam.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Sorting apparatus for receiving sheets of material delivered in succession from the sheet output station of a sheet-delivering device including in combination a housing mounted in stationary relation with respect to said output station, a frame supported for generally vertical movement relative to said output station by a plurality of elongated flexible members attached to rotatable winding drums carried by said housing, a plurality of sheet-receiving trays mounted for stacking movement within said frame, the distance between the lowermost and uppermost of said trays when they are arranged in a single stack being significantly less than the height of said frame, means for rotating said winding drums to lift said frame and a selected plurality of the trays therein to form a stack wherein the lowermost of the trays thus lifted is in a first position sufficiently high relative to said output station that a sheet exiting from said output station will pass below it, means for selectively dropping successively lowermost trays of said stack from said first position to a second position within said frame sufficiently low with respect to said output station that a sheet exiting said output station will be deposited thereon, and means for selectively causing said means for dropping successively lowermost trays of said stack to drop a single lowermost tray after the deposit on a tray in said second position of a predetermined number of sheets of material.

2. Sorting apparatus for receiving sheets of material delivered in succession from the sheet output station of a sheet-delivering device including in combination a housing mounted in stationary relation with respect to said output station, a frame supported for generally vertical movement relative to said output station by a plurality of elongated flexible members attached to rotatable winding drums carried by said housing, a plurality of sheet-receiving trays mounted for stacking movement within said frame, the distance between the lowermost and uppermost of said trays when they are arranged in a single stack being significantly less than the height of said frame, means for rotating said winding drums to lift said frame and a selected plurality of the trays therein to form a stack wherein the lowermost of the trays thus lifted is in a first position sufficiently high relative to said output station that a sheet exiting from said output station will pass below it, means for selectively dropping successively lowermost trays of said stack from said first position to a second position within said frame sufficiently low with respect to said output station that a sheet exiting said output station will be deposited thereon, and means for selectively causing said means for dropping successively lowermost trays of said stack to drop a single lowermost tray after the deposit on a tray in said second position of a single sheet of material.

3. Sorting apparatus for receiving sheets of material delivered in succession from the sheet output station of a sheet-delivering device including in combination a housing mounted in stationary relation with respect to said output station, a frame supported for generally vertical movement relative to said output station by a plurality of elongated flexible members attached to rotatable winding drums carried by said housing, a plurality of sheet-receiving trays mounted for stacking movement within said frame, the distance between the lowermost and uppermost of said trays when they are arranged in a single stack being significantly less than the height of said frame, means for rotating said winding drums to lift said frame and a selected plurality of the trays therein to form a stack wherein the lowermost of the trays thus lifted is in a first position sufficiently high relative to said output station that a sheet exiting from said output station will pass below it, and means for selectively dropping successively lowermost trays of said stack from said first position to a second position within said frame sufficiently low with respect to said output station that a sheet exiting said output station will be deposited thereon.

4. Sorting apparatus for receiving sheets of material delivered in succession from the sheet output station of a sheet-delivering device including in combination a plurality of sheet-receiving trays, means for positioning a selected plurality of said trays in a stack the lowermost tray of which is in a first position sufficiently high relative to such output station that a sheet exiting from said output station will pass below it, indexing means including a plurality of toothed escapement wheels selectively rotatable in unison, means on each of said trays engageable with said escapement wheels for holding the successively lowermost trays of said stack in said first position with the weight of all trays above it in each stack resting thereupon, means for selectively releasing said escapement wheels for rotation due to the weight of said stack of trays sufficient to release the lowermost tray held therein to drop by gravity to a second position sufficiently low relative to said output station that a sheet exiting said output station will be deposited thereon and for stopping rotation of said escapement wheels to hold a successive lowermost tray of said stack in said first position, and governor means for establishing a substantially constant angular velocity of rotation of said escapement wheels when released.

5. Sorting apparatus for receiving sheets of material delivered in succession from the sheet output station of a sheet-delivering device including in combination a plurality of horizontal sheet-receiving trays, means for positioning a selected plurality of said trays in a stack the lowermost tray of which is in a first position sufficiently high relative to such output station that a sheet exiting from said output station will pass below it, indexing means including a plurality of toothed escapement wheels selectively rotatable in unison, means on each of said trays at opposite ends thereof engageable with said escapement wheels for holding the successively lowermost trays of said stack in said first position with the weight of all trays above it in said stack resting thereupon, and means for selectively releasing said escapement wheels for rotation due to the weight of said stack of trays sufficient to release the lowermost tray held therein to drop by gravity to a second position sufficiently low relative to said output station that a sheet exiting said output station will be deposited thereon and for stopping rotation of said escapement wheels to hold a successive lowermost tray of said stack in said first position.

6. Sorting apparatus for receiving sheets of material delivered in succession from the sheet output station of a sheet-delivering device including in combination a plurality of horizontal sheet-receiving trays, means for positioning a selected plurality of said trays in a stack the lowermost tray of which is in a first position sufficiently high relative to such output station that a sheet exiting from said output station will pass below it, indexing means including a plurality of toothed escapement wheels selectively rotatable in unison, means on each of said trays at opposite ends thereof engageable with said escapement wheels for holding the successively lowermost trays of said stack in said first position, and means for causing said escapement wheels to rotate sufficiently to release a lowermost tray held therein to drop to a second position sufficiently low relative to said output station that a sheet exiting from said output station will be deposited thereon and for stopping rotation of said escapement wheels to hold a successive lowermost tray of said stack in said first position.

7. Sorting apparatus for receiving sheets of material delivered in succession from the sheet output station of a sheet-delivering device including in combination a frame mounted for generally vertical movement relative to said output station and having top members, bottom members and connecting members establishing a predetermined distance between said top and bottom members, a plurality of sheet-receiving trays mounted for stacking movement within said frame, the distance between the lowermost and uppermost of said trays when they are arranged in a single stack being significantly less than said predetermined distance, means for lifting said frame to position a selected plurality of the trays therein in an upper stack the lowermost tray of which is in a first position sufficiently high with respect to said output station that a sheet exiting said output station will pass below it, indexing means for holding the lowermost tray of said upper stack in said first position and for releasing successively lowermost trays of said upper stack to drop one at a time from said first position downwardly to form a lower stack of trays, means for terminating the operation of said means for lifting said frame, and means for lowering said frame relative to said upper stack of trays to a position in which said frame is supported by the top members thereof resting by gravity upon the top of said upper stack for downward movement as the height of said upper stack diminishes due to dropping of trays from said first position, said lower stack being supported by the lower members of said frame for said downward movement therewith whereby as the height of said lower stack increases due to dropping of trays thereon the successively uppermost trays of said lower stack will be in a second position sufficiently low with respect to said output station that a sheet exiting said output station will be deposited thereon.

8. Sorting apparatus for receiving sheets of material delivered in succession from the sheet output station of a sheet-delivering device including in combination a frame mounted for generally vertical movement relative to said output station and having top members, bottom members and connecting members establishing a predetermined distance between said top and bottom members, a plurality of sheet-receiving trays mounted for stacking movement within said frame, the distance between the lowermost and uppermost of said trays when they are arranged in a single stack being significantly less than said predetermined distance, means for lifting said frame to position a selected plurality of the trays therein in an upper stack the lowermost tray of which is in a first position sufficiently high with respect to said output station that a sheet exiting said output station will pass below it, indexing means for holding the lowermost tray of said upper stack in said first position and for releasing successively lowermost trays of said upper stack to drop one at a time from said first position downwardly to form a lower stack of trays, means for terminating the operation of said means for lifting said frame, and means for lowering said frame relative to said upper stack to a position in which said frame is supported by the top of said upper stack for downward movement as the height of said upper stack diminishes due to dropping of trays from said first position, said lower stack of trays being supported by said frame for said downward movement therewith whereby as the height of said lower stack increases the successively uppermost trays of said lower stack will be in a second position sufficiently low with respect to said output station that a sheet exiting said output station will be deposited thereon.

9. Sorting apparatus for receiving sheets of material delivered in succession from the sheet output station of a sheet-delivering device including in combination a frame mounted for generally vertical movement relative to said output station and having top members, bottom members and connecting members establishing a predetermined distance between said top and bottom members, a plurality of sheet-receiving trays mounted for stacking movement within said frame, the distance between the lowermost and uppermost of said trays when they are arranged in a single stack being significantly less than said predetermined distance, means for lifting said frame to position a selected plurality of the trays therein in an upper stack the lowermost tray of which is in a first position sufficiently high with respect to said output station that a sheet exiting said output station will pass below it, indexing means for holding the lowermost tray of said upper stack in said first position and for releasing successively lowermost trays of said upper stack to drop one at a time from said first position downwardly to form a lower stack of trays, means for terminating operation of said means for lifting said frame, and means for supporting said frame for downward movement as the height of said upper stack diminishes due to dropping of trays from said first position, said lower stack of trays being supported by said frame for said downward movement therewith whereby as the height of said lower stack increases the successively uppermost trays of said lower stack will be in a second position sufficiently low with respect to said output station that a sheet exiting said output station will be deposited thereon.

10. Sorting apparatus for receiving sheets of material delivered in succession from the sheet output station of a sheet-delivering device including in combination a frame mounted for generally vertical movement relative to said output station and having top members, bottom members and connecting members establishing a predetermined distance between said top and bottom members, a plurality of sheet-receiving trays mounted for stacking movement within said frame, the distance between the lowermost and uppermost of said trays when they are arranged in a single stack being significantly less than said predetermined distance, means for lifting a selected plurality of said trays into an upper stack the lowermost tray of which is in a first position sufficiently high relative to said output station that a sheet exiting said output station will pass below it, and indexing means for holding the lowermost tray of said upper stack in said first position and for releasing successively lowermost trays of said upper stack to drop one at a time from said first position downwardly to form a lower stack of trays, said frame being supported for downward movement as the height of said upper stack diminishes due to dropping of trays from said first position, said lower stack of trays being supported by said frame for said downward movement therewith whereby as the height of said lower stack increases the successively uppermost trays of said lower stack will be in a second position sufficiently low with respect to said output station that a sheet exiting said output station will be deposited thereon.

11. Sorting apparatus for receiving sheets of material delivered in succession from the sheet output station of a sheet-delivering device including in combination a plurality of sheet-receiving trays, means for positioning a selected plurality of said trays in an upper stack in which each tray supports all of the trays above it and the lowermost tray of which is in a first position sufficiently high relative to said output station that a sheet exiting from said output station will pass below it, indexing means for holding the successively lowermost trays of said upper stack in said first position and for releasing said successively lowermost trays to drop one at a time to form a lower stack in which each tray supports all of the trays above it and the uppermost tray of which is in a second position sufficiently low with respect to said output station that a sheet exiting from said output station will be deposited thereon, and means for supporting said lower stack from the top of said upper stack whereby said second position remains substantially constant as trays are successively dropped by said indexing means.

12. Sorting apparatus for receiving sheets of material delivered in succession from the sheet output station of a sheet-delivering device including in combination a frame, means for mounting said frame in fixed relation with said output station, a carriage mounted for reciprocating movement in said frame, a plurality of sheet-receiving trays mounted for reciprocating movement in said carriage, means for elevating all of said trays to a position above said output station, a bottom tray spaced a predetermined distance from the lowermost of said plurality of trays when said plurality of trays is in elevated position, said spaced distance being located adjacent said output station, escapement means for supporting said elevated trays, and means responsive to the deposit of a sheet on a tray for actuating said escapement means for dropping a lowermost tray of said plurality of trays and simultaneously lowering said bottom tray whereby to maintain said spaced distance between trays adjacent said output station substantially constant as the uppermost trays are released in succession by the escapement means.

* * * * *